US012601230B2

(12) United States Patent
Koivumaki et al.

(10) Patent No.: US 12,601,230 B2
(45) Date of Patent: Apr. 14, 2026

(54) CONTROL SYSTEM, ROCK DRILLING RIG, AND METHOD FOR CONTROLLING COUPLING MEASURES

(71) Applicant: SANDVIK MINING AND CONSTRUCTION OY, Tampere (FI)

(72) Inventors: Perttu Koivumaki, Tampere (FI); Jarkko Uotila, Tampere (FI); Eero Viskari, Tampere (FI); Visa Toppinen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 18/722,721

(22) PCT Filed: Dec. 9, 2022

(86) PCT No.: PCT/EP2022/085216
§ 371 (c)(1),
(2) Date: Jun. 21, 2024

(87) PCT Pub. No.: WO2023/117501
PCT Pub. Date: Jun. 29, 2023

(65) Prior Publication Data

US 2025/0154836 A1 May 15, 2025

(30) Foreign Application Priority Data

Dec. 23, 2021 (EP) ..... 21217318

(51) Int. Cl.
*E21B 19/16* (2006.01)
*E21B 17/042* (2006.01)

(52) U.S. Cl.
CPC ..... *E21B 19/165* (2013.01); *E21B 17/042* (2013.01)

(58) Field of Classification Search
CPC ..... E21B 19/165; E21B 17/042
See application file for complete search history.

(56) References Cited

U.S. PATENT DOCUMENTS

| | | | | |
|---|---|---|---|---|
| 4,449,592 | A * | 5/1984 | Mayer | E21B 19/20 175/57 |
| 5,348,106 | A | 9/1994 | Mattero | |
| 2015/0152697 | A1* | 6/2015 | Gustavsson | E21B 3/025 175/52 |
| 2015/0218895 | A1* | 8/2015 | Hassan | E21B 15/00 175/24 |
| 2019/0309878 | A1* | 10/2019 | Ruehmann | E21B 10/62 |
| 2019/0368335 | A1* | 12/2019 | Miller | E21B 44/04 |
| 2024/0011387 | A1* | 1/2024 | Mörtzell | E21B 44/06 |

(Continued)

FOREIGN PATENT DOCUMENTS

| | | | |
|---|---|---|---|
| NO | 317821 | B1 | 12/2004 |
| WO | 2018106287 | A1 | 6/2018 |

*Primary Examiner* — Taras P Bemko
(74) *Attorney, Agent, or Firm* — Corinne R. Gorski

(57) ABSTRACT

A control system, rock drilling rig and method for controlling coupling measures is provided. The control system is arranged for controlling coupling and uncoupling measures of a threaded coupling of a rock drilling tool. The control system is configured to detect initial minimum feed force required for moving a rock drilling apparatus in forward direction and is configured to implement the detected minimum feed force during the coupling.

8 Claims, 4 Drawing Sheets

(56) References Cited

U.S. PATENT DOCUMENTS

| | | | | |
|---|---|---|---|---|
| 2024/0068352 | A1* | 2/2024 | Wiedenmann | E21B 44/04 |
| 2024/0102377 | A1* | 3/2024 | Göthberg | E21B 44/00 |
| 2024/0159115 | A1* | 5/2024 | Mörtzell | E21B 19/165 |

* cited by examiner

CONTROL SYSTEM, ROCK DRILLING RIG, AND METHOD FOR CONTROLLING COUPLING MEASURES

RELATED APPLICATION DATA

This application is a § 371 National Stage Application of PCT International Application No. PCT/EP2022/085216 filed Dec. 9, 2022 with priority to EP 21217318.1 filed Dec. 23, 2021.

BACKGROUND OF THE INVENTION

The invention relates to a control system for controlling coupling and uncoupling measures of a threaded coupling of a rock drilling tool.

The invention further relates to a rock drilling rig and to a method of connecting a threaded coupling of a drilling tool.

The field of the invention is defined more specifically in the preambles of the independent claims. In mines and at other work sites different type of rock drilling rigs are used for drilling drill holes to rock surfaces. The drilling rig comprises a rock drilling machine provided with a drilling tool. The drilling tool may comprise several drill rods or tubes and a drill bit at a free end of the drilling tool. The mentioned drilling tool components can be connected to each other by means of threaded couplings. Further, the drilling tool is connectable to a shank adapter or corresponding connecting element of the rock drilling machine by means of threaded couplings. There are different solutions for executing coupling measures of the drilling tools. However, the known solutions have shown some disadvantages.

BRIEF DESCRIPTION OF THE INVENTION

An object of the invention is to provide a novel and improved control system and method for controlling coupling measures of a threaded coupling of a rock drilling tool. A further object is to provide a new and improved rock drilling rig implementing such control system and method.

The control system according to the invention is characterized by the characterizing features of the first independent apparatus claim.

The rock drilling rig according to the invention is characterized by the characterizing features of the second independent apparatus claim.

The method according to the invention is characterized by the characterizing features of the independent method claim.

An idea of the disclosed solution is that a rock drilling rig is provided with a control system for controlling coupling and uncoupling measures of a threaded coupling of a rock drilling tool. The control system is configured to control operation of a rotating device and a feed device of a rock drilling apparatus. Then the rotating device is rotatable in coupling direction and in uncoupling direction under control of the control system, and further, the feed device is configured to produce feed movement in forward direction and in backward direction for executing the coupling and uncoupling measures. The control system determines minimum feed force needed for moving the rock drilling apparatus in the forward direction, and then the control system controls the feed device to feed the rock drilling apparatus in the forward direction by utilizing the detected minimum feed force. In other words, only as low feed force as possible is implemented during the coupling measures.

An advantage of the disclosed solution is that since the forward movement in generated with low force level, the wear and damages of the threads caused by too powerful feed force can be decreased.

According to an embodiment, the coupling can be executed downwards, in angled orientation or upwards depending on the drilling situation and implemented drilling process. Thus, the minimum feed force depends on the used drilling method, since the gravity effects differently to the minimum feed force in different drilling and coupling directions, of course.

According to an embodiment, the rock drilling apparatus or machine may be a rotation head intended for rotary drilling, down-the-hole drilling (DTH), in-the-hole drilling (ITH), or alternatively, it may be a top hammer rock drilling machine provided with an impact device together with the rotating device. Thus, the disclosed solution can be implemented in different drilling methods.

According to an embodiment, the determined minimum feed force may be considered as a compensation force against forces preventing free movement in the forward direction. The compensation force compensates phenomena which try to prevent the drilling machine from moving, such as the gravity and static friction.

According to an embodiment, the determined minimum feed force may be a supporting force, or a so called hold back force, for supporting the drilling machine when drilling downwards. Then, there may be a need to support the drilling machined with negative feed force against the gravity. Also, in this case there is a need to determine the minimum feed force in accordance with this document.

According to an embodiment, the feed device is a hydraulic actuator, such as a hydraulic cylinder or a hydraulic motor. The hydraulic feed device is connected to a hydraulic circuit for powering it with hydraulic fluid flow and pressure. Then the feed force is controlled by adjusting pressure of the hydraulic fluid supplied to the feed device, and the feed speed is controlled by adjusting magnitude of the fluid flow fed to the feed device.

According to an embodiment, the control system is configured to provide the feed device with a speed request for keeping the feed speed at requested level during the coupling measures. In other words, only one single feed speed request may be implemented for the entire coupling phase. The speed request submitted to the feed device may be a fast speed request. Then the rock drilling machine can execute fast and free approaching movement with the low feed force towards the drilling tool since forces resisting the feed speed may be low before the actual threading. However, when the actual threading starts, then the feed speed is determined automatically by the rotation speed and pitch of the screw surfaces of the connecting threads. No damages are caused despite of the possible fast feed speed request since the feed force is low. The rotation speed and the pitch determine the feed speed during the threading phase. An advantage of this embodiment is that free axial movement before the threading can be done quickly so that the coupling process can be fast. And still, since low feed forces are used, there is no risk of damaging the mating thread parts when they face axially each other.

According to an embodiment, the control system is configured to provide the rotating device with rotating request to produce constant rotation speed in the coupling direction during the coupling process and feed movement in the forward direction. Since the rotation is already on when approaching thread contact and since the feed forces are low, there is no need to determine accurate axial position where the threading of the thread parts begin, but instead, the approach phase can switch smoothly and without separate control measures to the threading phase. Then the process is simple to control and avoids needless stoppages. When the threads are in contact the feed speed is defined by a pitch of the threads and rotation speed i.e., natural feed speed is then applied. There is no need to match the rotation speed and the feed speed. This way, the rotation speed can be set freely.

According to an embodiment, the control system is further configured to: determine the minimum feed force initially at the beginning of the coupling; monitor the movement of the rock drilling apparatus in the forward direction until threading of connecting threads is initiated; and increase magnitude of the feed force in response to detected stoppage of the movement in the forward direction. In other words, a feed sensitive coupling is provided wherein the control system adds magnitude of the increased feed force to the initially detected minimum feed force in response to the movement monitoring data. This control principle, with the monitoring and the increased feed force, is implemented only in the approaching phase. During the threading phase there is no need for similar control. That is because the feed force is generated automatically by the used torque and the pitch. An advantage of this embodiment is that the system ensures that the needed axial movement occurs during the approach, and that as low level of feed force as possible is implemented for generating the forward movement. The control may be automatic without a need for manual control measures of an operator. Thereby, human errors can be avoided, and the operator can focus on controlling other issues during the coupling process.

According to an embodiment, the above mentioned initially determined minimum feed force is implemented as a base feed force data on which values of the increased feed forces are added.

According to an embodiment, the control system increases the magnitude of feed force only until the axial movement in the forward direction occurs and is detected. Thus, the control system continues the forward movement with combined feed force comprising the initial minimum feed force and the detected increase in the feed force. In other words, the control system ramps up the feed force for generating the forward movement, and when the movement is detected, the ramping up is terminated and the forward movement continues with the determined feed force level to maintain the movement.

According to an embodiment, the control system is configured to determine movement of the rock drilling apparatus in response to motion detection data received from at least one motion detecting device. In other words, there may be one or more sensors arranged in connection with the feed device or a feed beam for sensing the movements of the rock drilling apparatus.

According to an embodiment, the control system is configured to determine the forward movement by means of calculation. The control system may monitor operation of the feed device and features of hydraulic fluid, or possible other driving energy, supplied to it, and determine the movement by executing comparisons and calculations. For example, the motion detecting device may comprise one or more pressure sensors configured to sense pressure setting values and realized pressure values, whereby the control unit may detect the movement by comparing the received pressure sensing data. In this solution the pressure sensing data serves as the mentioned motion detection data.

According to an embodiment, the feed device controlled by the control system is a hydraulic actuator connected to a hydraulic circuit for providing pressurized hydraulic fluid to the feed device for actuating the feed movements. Further, the control system is configured to detect minimum pressure of the hydraulic fluid fed to the feed device required for moving the rock drilling apparatus in the forward direction and implements the detected minimum pressure as the minimum feed force. In other words, the control of feed force sensitive coupling utilizes as low feed pressure as possible for moving the drilling apparatus in the forward direction during a coupling phase.

According to an embodiment, the feed device controlled by the control system is a hydraulic actuator connected to a hydraulic circuit for providing pressurized hydraulic fluid to the feed device for actuating the feed movements. Further, the control system comprises at least one dedicated control device for controlling the pressure of the hydraulic fluid fed to the hydraulic feed device during the feeding in forward direction. In other words, the pressure can be controlled by means of the dedicated control device independently when moving in the forward direction.

According to an embodiment, the control system comprises dedicated control devices for independent control of hydraulic pressure fed to the hydraulic feed device during the feeding in forward and backward direction.

According to an embodiment, the above mentioned control device is a control valve.

According to an embodiment, the above mentioned control device comprises one or more control elements or actuators for controlling properties of a hydraulic pump, or pump unit, which is powering the feed device.

According to an embodiment, the control system may calculate or determine additional feed force in response to the detected minimum feed force and may utilize combination of the minimum feed force and the additional feed force in the control of the feed device. In other words, the control system may add the determined additional feed force, or surplus force, to increase the utilized force slightly over the minimum feed force. An advantage of this embodiment is that continuous movement in the forward direction is ensured also in situations when friction forces are changed, for example.

According to an embodiment, the above mentioned additional feed force is calculated in a processor of the control system and is 2-10% of the minimum feed force. Thus, the implemented feed force is 1.02 to 1.1 times the minimum feed force.

According to an embodiment, the disclosed solution relates to a rock drilling rig for drilling drill holes. The rock drilling rig comprises a movable carrier and at least one rock drilling unit comprising a feed beam and a rock drilling apparatus arranged movably on the feed beam. The rock drilling apparatus comprises a rotating device for rotating a drilling tool connectable to the rock drilling unit. A feed device is arranged for feeding the drilling tool in drilling direction and in reverse direction. There is at least one control system for controlling at least the feed device and the rotating device. The rock drilling apparatus and the drilling tool are connected releasably to each other by means of threaded couplings. Further, the control system of the rock drilling rig is in accordance with the features and embodiments disclosed in this document.

According to an embodiment, the disclosed solution relates to a method of connecting a threaded coupling of a drilling tool. The drilling tool is connectable to a rock drilling apparatus comprising at least a feed device and a rotating device. The method comprises connecting the coupling by feeding the rock drilling apparatus in forward direction by means of the feed device and executing simultaneous rotation in connecting direction by means of the rotating device. The method further comprises determining minimum feed force required for providing movement in the forward direction and feeding the rock drilling apparatus in forward direction with the determined minimum feed force during the coupling.

According to an embodiment, the method comprises controlling the feed device, by means of a control device, to maintain unchanged feed speed request during the entire coupling. In other words, the method comprises providing the feed device with one single feed speed request for the coupling.

According to an embodiment, the method comprises executing rotation in the coupling direction during the entire coupling. In other words, the rotation is already on during the approaching movement whereby the threading can start smoothly at once the connecting threads are met axially.

According to an embodiment, the method comprises monitoring forward approaching movement before initiating actual threading and updating the required minimum feed force. The method further comprises implementing the updated minimum feed force for ensuring the approaching movement.

In other words, if the forward movement stops in the approaching phase, then new minimum feed force required for continuing the movement is determined. After that the new minimum feed force represents an updated compensation force implemented in the control of the feed device. During the threading phase this control is not implemented.

According to an embodiment, the method comprises using the detected minimum feed force as a compensation force during a threading phase of the coupling, wherein the implemented rotation speed and a pitch of the coupling thread define a nominal feed speed when threaded elements of the coupling are connected to each other.

The above disclosed embodiments may be combined in order to form suitable solutions having those of the above features that are needed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
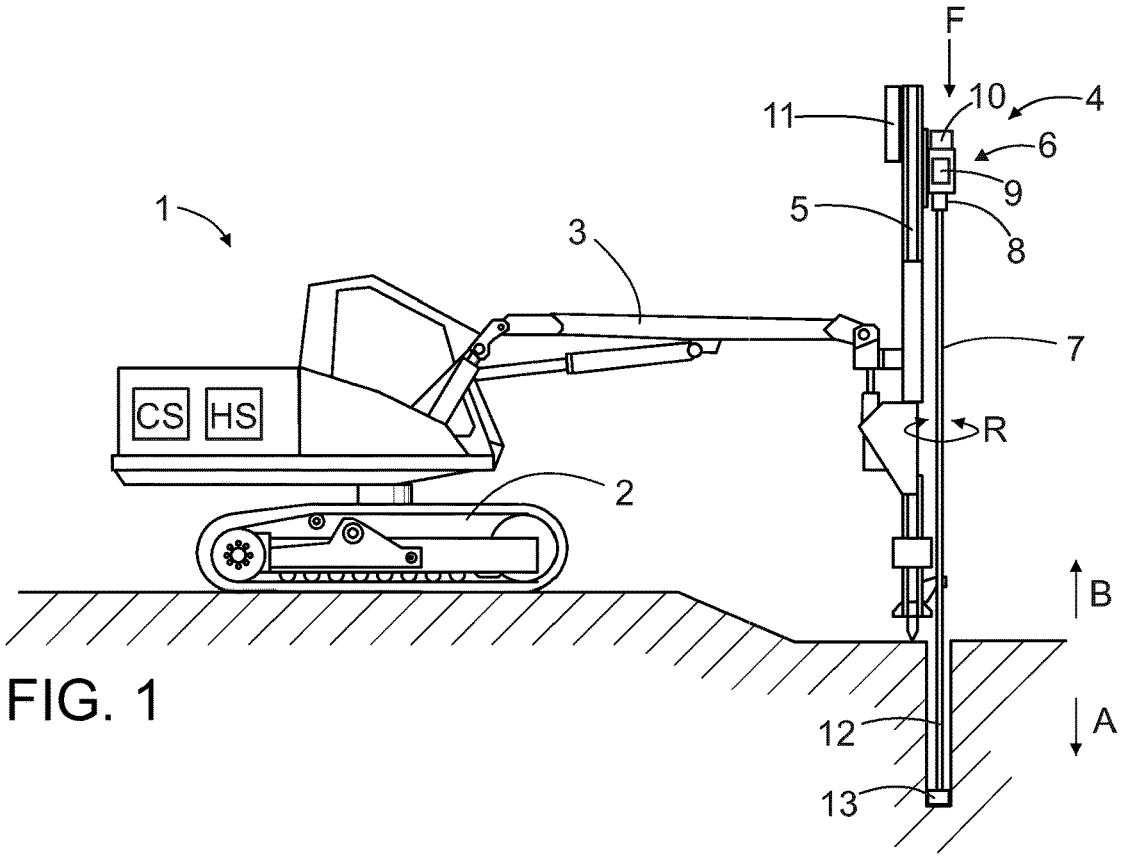
FIG. 1 is a schematic side view of a rock drilling rig for surface drilling.

FIG. 1 shows a rock drilling rig 1 intended for surface drilling. The rock drilling rig 1 comprises a movable carrier 2 and at least one drilling boom 3 connected to the carrier 2. At a distal end portion of the drilling boom 3 is a drilling unit 4 provided with a feed beam 5 and a rock drilling apparatus 6 supported on it. A drilling tool 7 is connectable to the drilling apparatus 6. The rock drilling apparatus 6 may comprise a shank adapter 8 at a front end of the rock drilling apparatus 6 for connecting the tool 7. The rock drilling apparatus 6 further comprises a rotating device 9 for rotating R the shank adapter 8 and the connected drilling tool 7. When the rock drilling apparatus 6 is of top hammer type, it may additionally comprise an impact device 10. The rock drilling machine 6 can be moved on the feed beam 5 in forward direction A and reverse direction B by means of a feed device 11.

The drilling tool 7 may comprise one or more drilling tubes or rods 12 and a drill bit 13 at a distal end of the drilling tool 7. Thus, the drilling 7 may comprise several drilling components connected to each other by means of connecting threads. There may also be connecting threads between the shank adapter 8 and the drilling tool 7. Coupling of the threaded couplings can be controlled under control of a control system CS in accordance with the features and measures disclosed in this document. FIG. 1 further discloses a hydraulic system HS provided with one or more hydraulic circuits for powering hydraulically operable actuators.

Figure 2:
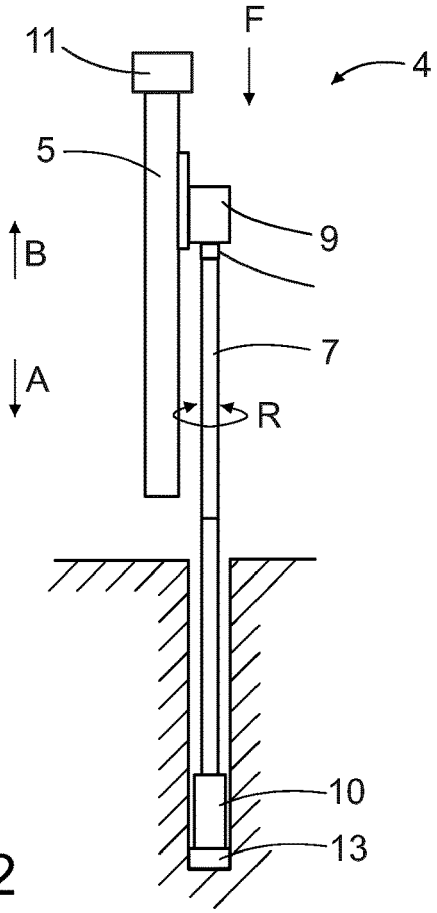
FIG. 2 is schematic view of a rock drilling machine implementing DTH drilling method.

FIG. 2 discloses an alternative drilling method wherein the disclosed solution can be implemented for coupling threaded connections of drilling components. FIG. 2 discloses a DTH drilling unit 4, wherein an impact device 10 is located adjacent a drill bit 13 and a rotating device 9 or a rotating head is mounted on a feed beam 5. A drilling tool 7 may be connected to the rotating device 9 by means of connecting threads and there may be thread connections also between drill tubes and other drilling components. The disclosed coupling control system is therefore useful in the DTH drilling and also in rotary drilling with no impact device.

Figure 3:
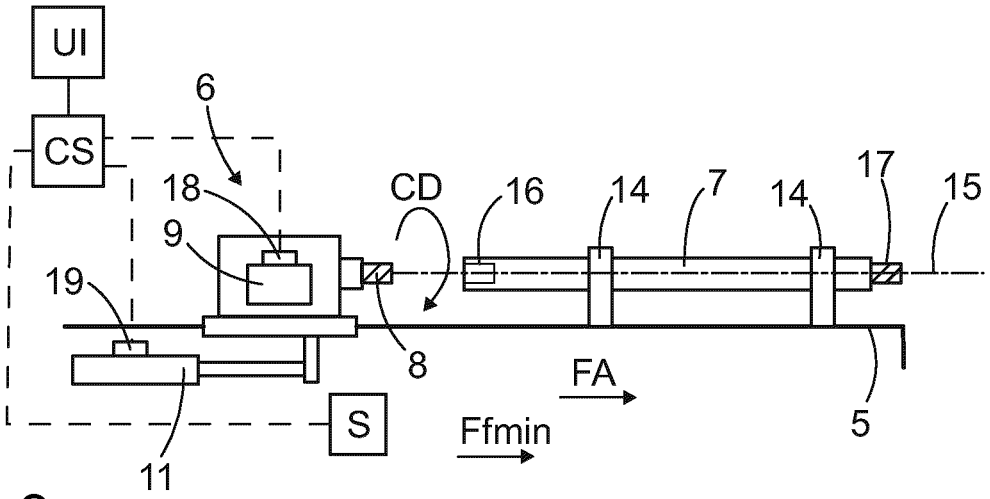
FIGS. 3-5 are schematic side views showing coupling phases for connecting a drilling tube to a rock drilling apparatus.
Figure 4:
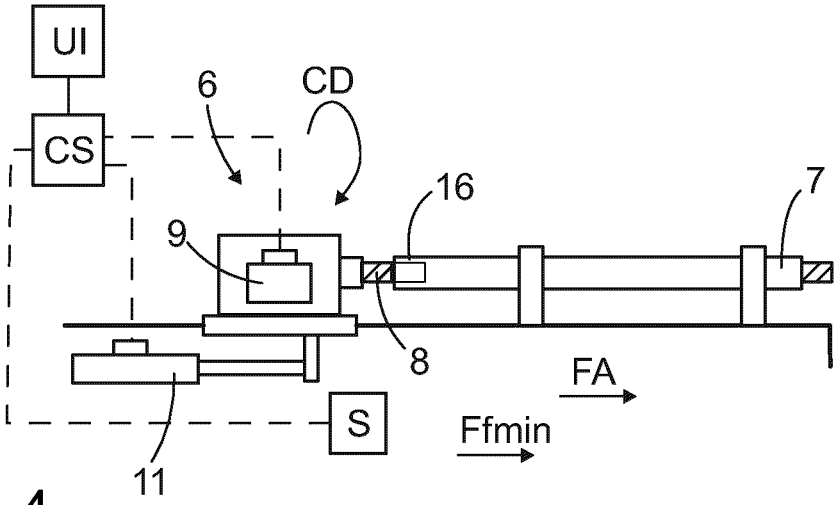
Figure 5:
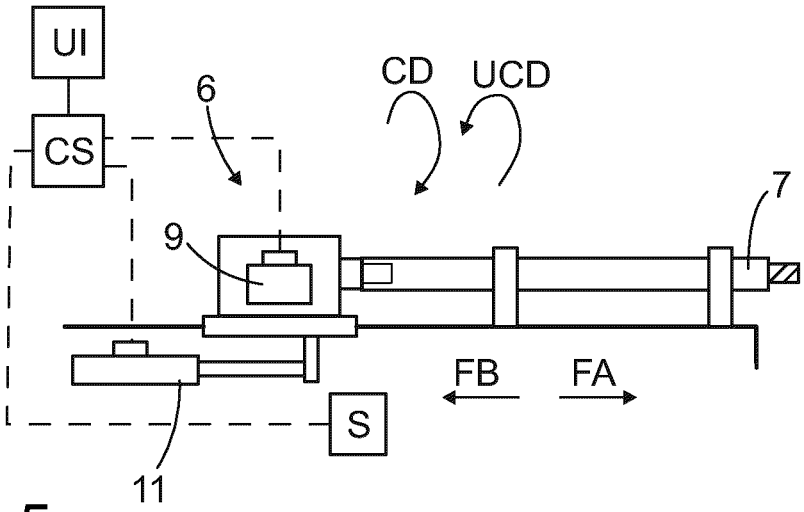

FIGS. 3-5 disclose some coupling measures of a drilling tool 7 in a highly simplified manner.

The drilling tool 7, in this case a drilling tube, may be supported on a feed beam 5 by means of one or more support elements 14 so that the drilling tube is aligned on drilling axis 15. The support means may comprise a holding device or clamp, a manipulator for moving the drilling components between the drilling axis and a drilling component magazine, or any other element or device suitable for providing needed support for the drilling component until it is coupled to a rock drilling apparatus 6. A shank adapter 8 or a corresponding rotatable connecting member is provided with connecting threads as well as the drilling tool 7. There is a female end 16 with inner threads at a first end closest to the shank adapter 8 and a male end 17 with outer threads at an opposite second end. In FIG. 3 the drilling tool 7 is located at axial distance from the rock drilling apparatus 6 wherefore coupling measures include moving the rock drilling apparatus 6 axially in forward direction FA so that the threads of the shank adapter 8 and the female end 16 face to each other. This forward movement can be called as an approaching movement or approach. The approaching movement is executed with the lowest possible feed force Ffmin. Thus, prior to executing the approaching movement it is determined magnitude of the minimum feed force Ffmin by detecting force that is needed to cause the rock drilling apparatus 6 to move in the forward direction FA. A movement sensing device S may be arranged to detect real physical movement of the rock drilling apparatus and sensing data may be submitted to a control system CS which is arranged to control the coupling process and related actuators and devices.

The control system CS generates control commands or requests for the feed device 11 and may execute the approaching movement towards the drilling tool 7 with the detected minimum feed force Ffmin. If the approaching movement is stopped because of increased magnitude of forces resisting the approaching movement, then the control system CS may update magnitude of the feed force so that the movement can be resumed. Further, the approaching movement can be executed with high speed during the approaching, and the shank adapter 8 can be rotated in coupling direction CD already during the approach.

The control system CS may comprise a processor or data processing device for executing automatic coupling measures. The control system may comprise one or more computers or control units. The control system CS may communicate with a user interface and may receive sensing data from one or more sensing devices S. The sensor S may be a motion detecting device, speed sensor or position sensor, for example. The control system CS can generate control commands and requests for control elements 18, 19 for controlling properties of hydraulic fluid directed to the rotating device 9 and the feed device 11 which may be hydraulic actuators.

Movements of the rock drilling apparatus 6 can be determined alternatively, or in addition to, by monitoring features of the hydraulic fluid, such as pressure and flow, and executing calculations or comparison in the processor of the control system. Thus, hydraulic circuits may be equipped with pressure sensors, for example.

In FIG. 4 the approaching movement is completed and the rock drilling apparatus 6 is moved in forward direction FA so that threading between the shank adapter 8 and the female end 16 can begin. When the threads are in contact the feed speed is defined by a pitch of the threads and rotation speed.

In the disclosed solution, it is not necessary to detect relative positions of the shank adapter 8 and the female end 16 because as low feed force as possible is implemented during the approaching movement and the mating surface will not damage when they collide. Transfer from the approaching movement or phase to the threading phase is smooth.

In FIG. 5 the threading is completed and the drilling tool 7 is properly connected to the rock drilling apparatus 6. FIG. 5 further discloses rotation direction in uncoupling direction UCD and feeding in reverse or backward direction FB which are needed when uncoupling thread connections between the drilling components and the rock drilling apparatus.

In FIGS. 3-5 coupling between the rock drilling apparatus 6 and the drilling tool 7 is disclosed but of course the same principles and measures can be implemented when coupling threads between two drill tubes and between a drill tube and a drill bit, for example.

Figure 6:
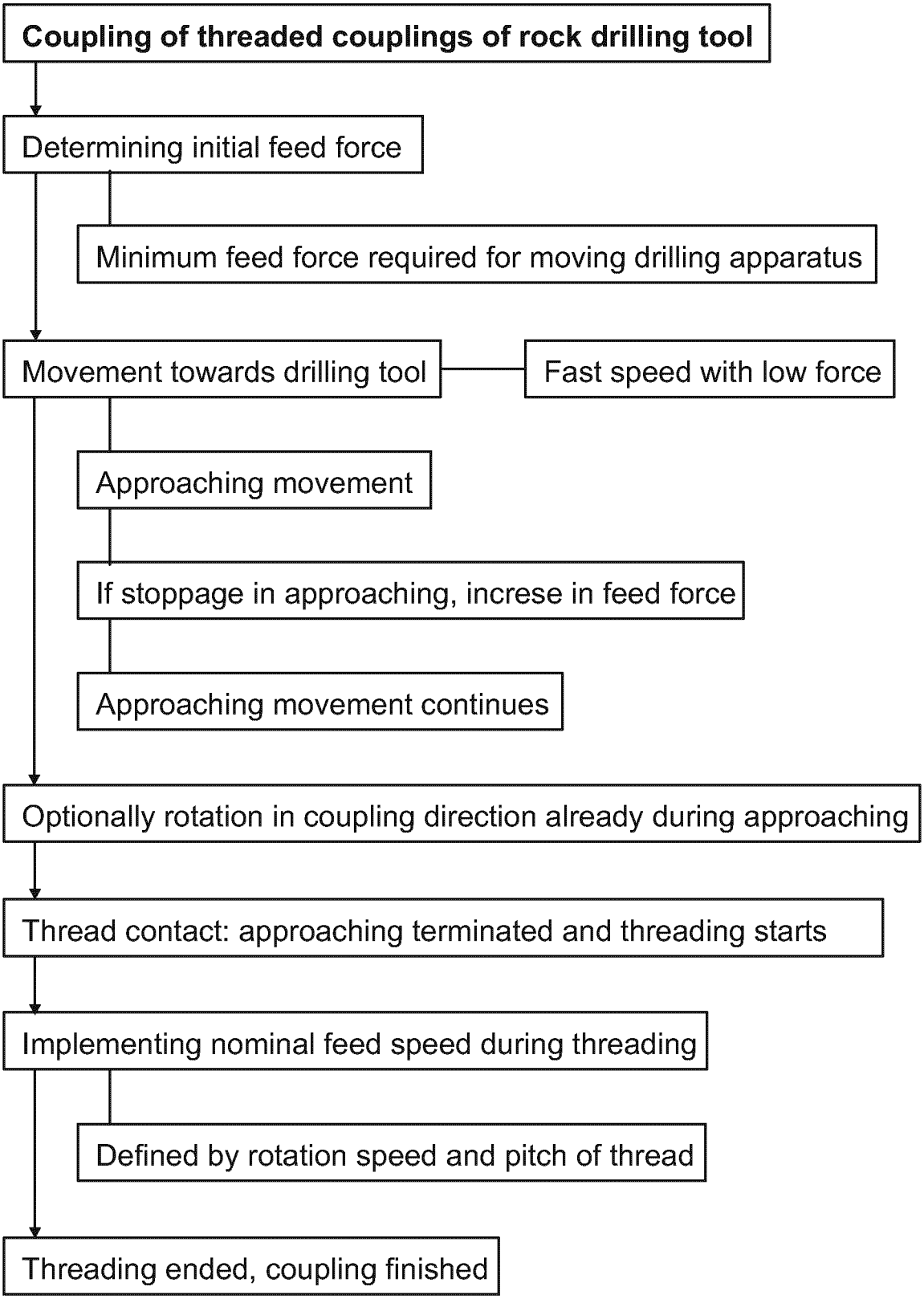
FIG. 6 is a schematic diagram showing some features relating to the coupling measures.

FIG. 6 is a simple diagram of steps of a coupling process and a few additional features. These issues are already disclosed widely above in this document.

Figure 7:
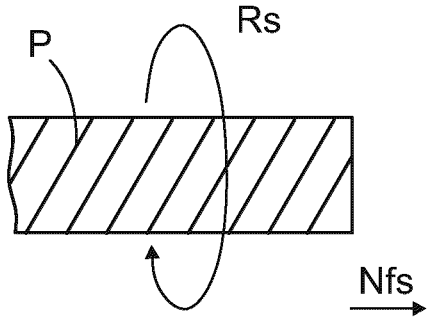
FIG. 7 is a schematic side view of part of a coupling thread and principles of determining nominal feed speed.

FIG. 7 discloses part of coupling thread having screw surfaces 20 with a pitch P. The coupling thread is rotated with rotation speed Rs in coupling direction. Then there occurs nominal feed speed Nfs, or natural thread speed, which is dependent on the pitch P and the rotation speed Rs.

The drawings and the related description are only intended to illustrate the idea of the invention. In its details, the invention may vary within the scope of the claims.

The invention claimed is:

1. A control system for controlling coupling and uncoupling measures of a threaded coupling of a rock drilling tool, the control system being configured to:

control operation of a rotating device and a feed device of a rock drilling apparatus, whereby the rotating device is rotatable in a coupling direction and in an uncoupling direction, and wherein the feed device is configured to produce feed movement in a forward direction and in a backward direction;

determine a minimum feed force (Ffmin) required for moving the rock drilling apparatus in the forward direction;

apply the minimum feed force (Ffmin) when controlling the feed device to feed the rock drilling apparatus in the forward direction;

determine additional feed force; and add the determined additional feed force on the minimum feed force (Ffmin) during the control of the feed device, wherein the feed device controlled by the control system is a hydraulic actuator connected to a hydraulic circuit for providing pressurized hydraulic fluid to the feed device for actuating the feed movements, and wherein the control system includes at least one dedicated control device for controlling the pressure of the hydraulic fluid fed to the hydraulic feed device during the feeding in forward direction.

2. The control system as claimed in claim 1, wherein the control system is configured to provide the feed device with a speed request for keeping the feed speed at a requested level during the coupling measures.

3. The control system as claimed in claim 1, wherein the control system is configured to determine movement of the rock drilling apparatus in response to motion detection data received from at least one motion detecting device.

4. The control system as claimed in claim 1, wherein the feed device controlled by the control system is a hydraulic actuator connected to a hydraulic circuit for providing pressurized hydraulic fluid to the feed device for actuating the feed movements, the control system being configured to detect minimum pressure of the hydraulic fluid fed to the feed device required for moving the rock drilling apparatus in the forward direction, and wherein the control system is configured to implement the detected minimum pressure as the minimum feed force (Ffmin).

5. The control system as claimed in claim 1, wherein the additional feed force is 2-10% of the minimum feed force (Ffmin).

6. A rock drilling rig arranged for drilling drill holes, the rock drilling rig comprising:

a movable carrier;

at least one rock drilling unit including a feed beam and a rock drilling apparatus arranged movably on the feed beam, wherein the rock drilling apparatus includes a rotating device arranged for rotating a drilling tool connectable to the rock drilling unit, and a feed device arranged for feeding the rock drilling apparatus in a drilling direction and in a reverse direction; and at least one control system in accordance with claim 1, the control system being arranged for controlling at least the feed device and the rotating device, wherein the rock drilling apparatus and the drilling tool are connected releasably to each other by means of threaded couplings.

7. A method of connecting a threaded coupling of a drilling tool, the drilling tool being connectable to a rock drilling apparatus including at least a rotating device and movable by means of a feed device, the method comprising:

connecting the coupling by feeding the rock drilling apparatus in a forward direction by means of the feed device and executing simultaneous rotation in connecting direction by means of the rotating device;

determining minimum feed force (Ffmin) required for providing movement in the forward direction;

applying the determined minimum feed force (Ffmin) when feeding the rock drilling apparatus in forward direction during the coupling; and by determining additional feed force and adding the determined additional feed force on the minimum feed force (Ffmin) when feeding the rock drilling apparatus; and using the detected minimum feed force (Ffmin) as a compensation force during a threading phase of the coupling, wherein the implemented rotation speed and a pitch of the coupling thread define nominal feed speed when threaded elements of the coupling are connected to each other.

8. The method as claimed in claim 7, further comprising executing rotation in the coupling direction during the entire coupling.

* * * * *